US011200845B2

(12) United States Patent
Meng et al.

(10) Patent No.: US 11,200,845 B2
(45) Date of Patent: Dec. 14, 2021

(54) DRIVING METHOD AND DRIVING CONTROL METHOD FOR PIXEL CIRCUIT

(71) Applicants: Hefei Xinsheng Optoelectronics Technology Co., Ltd., Anhui (CN); BOE Technology Group Co., Ltd., Beijing (CN)

(72) Inventors: Song Meng, Beijing (CN); Yongqian Li, Beijing (CN)

(73) Assignees: HEFEI XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/094,193

(22) Filed: Nov. 10, 2020

(65) Prior Publication Data

US 2021/0193044 A1 Jun. 24, 2021

(30) Foreign Application Priority Data

Dec. 20, 2019 (CN) ..... 201911328016.4

(51) Int. Cl.
*G09G 3/3258* (2016.01)
*G09G 3/3291* (2016.01)
*G09G 3/3266* (2016.01)

(52) U.S. Cl.
CPC ..... *G09G 3/3258* (2013.01); *G09G 3/3266* (2013.01); *G09G 3/3291* (2013.01); *G09G 2300/0426* (2013.01)

(58) Field of Classification Search
CPC ... G09G 3/3258; G09G 3/3266; G09G 3/3291
See application file for complete search history.

(56) References Cited

U.S. PATENT DOCUMENTS 10,339,861 B2 * 7/2019 Kim ..... G09G 3/3233
2014/0204067 A1 * 7/2014 Gupta ..... G09G 3/3291 345/211
2016/0189623 A1 * 6/2016 Miwa ..... G09G 3/3258 345/212

* cited by examiner

*Primary Examiner* — Sardis F Azongha
(74) *Attorney, Agent, or Firm* — Nath, Goldberg & Meyer; Joshua R Goldberg

(57) ABSTRACT

There is provided a driving method for a pixel circuit including a driving transistor, a data writing circuit, a sensing circuit, and a storage capacitor. The driving method includes: during a sensing write stage, writing a test voltage equal to a sum of a first reference voltage and a threshold voltage of the driving transistor, by the data writing circuit, to the control electrode of the driving transistor, and writing a second reference voltage, by the sensing circuit, to a second electrode of the driving transistor; during a sensing sampling stage, continuing to write the test voltage to the control electrode of the driving transistor by the data writing circuit, and stopping writing a voltage to the second electrode of the driving transistor by the sensing circuit. The driving method further includes a sensing reset stage and a sensing charging stage.

20 Claims, 8 Drawing Sheets

DRIVING METHOD AND DRIVING CONTROL METHOD FOR PIXEL CIRCUIT

CROSS REFERENCE TO RELATED APPLICATIONS

The present application claims the priority of Chinese patent application No. 201911328016.4, filed on Dec. 20, 2019, the content of which is incorporated herein by reference in its entirety.

TECHNICAL FIELD

The present disclosure relates to the field of display technologies, and in particular, to a driving method for a pixel circuit, a driving control method for a pixel circuit, and a non-transitory computer-readable storage medium.

BACKGROUND

During a manufacturing process of an organic light emitting diode (OLED) display panel in the related art, structures of a pixel circuit of the OLED display panel may be nonuniform due to influences such as a manufacturing error, an external environment, or the like. Thus, it is necessary to improve display nonuniformity caused by structural nonuniformity of the pixel circuit through an internal compensation or an external compensation during a driving process of the pixel circuit.

However, the driving process of the pixel circuit of the OLED display panel in the related art has a poor compensation effect, and cannot completely solve the problem of display nonuniformity of the OLED display panel.

SUMMARY

A first aspect of the present disclosure provides a driving method for a pixel circuit, wherein the pixel circuit includes a driving transistor, a data writing circuit, a sensing circuit, and a storage capacitor;

the data writing circuit is coupled to a first gate line, a data line and a control electrode of the driving transistor, respectively, the sensing circuit is coupled to a second gate line, a signal sensing line and a second electrode of the driving transistor, respectively, a first electrode of the driving transistor is coupled to a first voltage terminal, a first terminal of the storage capacitor is coupled to the control electrode of the driving transistor, and a second terminal of the storage capacitor is coupled to the second electrode of the driving transistor;

the driving method includes:

during a sensing write stage, writing a test voltage equal to a sum of a first reference voltage and a threshold voltage of the driving transistor, by the data writing circuit, to the control electrode of the driving transistor in response to control of the first gate line, and writing a second reference voltage, by the sensing circuit, to the second electrode of the driving transistor in response to control of the second gate line;

during a sensing sampling stage, continuing to write the test voltage to the control electrode of the driving transistor by the data writing circuit in response to the control of the first gate line, and stopping writing a voltage to the second electrode of the driving transistor by the sensing circuit in response to the control of the second gate line;

during a sensing reset stage, stopping writing a voltage to the control electrode of the driving transistor by the data writing circuit in response to the control of the first gate line, and writing the second reference voltage to the second electrode of the driving transistor again by the sensing circuit in response to the control of the second gate line; and during a sensing charging stage, continuing to stop writing a voltage to the control electrode of the driving transistor by the data writing circuit in response to the control of the first gate line, and allowing, by the sensing circuit, a current output from the second electrode of the driving transistor to flow to the signal sensing line in response to the control of the second gate line so as to charge the signal sensing line.

In some embodiment, the driving method further includes, prior to the sensing write stage:

determining the threshold voltage of the driving transistor.

In some embodiment, the driving method further includes, after the sensing charging stage:

during a data writing stage, writing a compensated data voltage to the control electrode of the driving transistor by the data writing circuit in response to the control of the first gate line, and writing the second reference voltage to the second electrode of the driving transistor by the sensing circuit in response to the control of the second gate line;

during an internal compensation stage, continuing to write the compensated data voltage to the control electrode of the driving transistor by the data writing circuit in response to the control of the first gate line, and stopping writing a voltage to the second electrode of the driving transistor by the sensing circuit in response to the control of the second gate line; and during a continuous light emission stage, stopping writing a voltage to the control electrode of the driving transistor by the data writing circuit in response to the control of the first gate line, and continuing to stop writing a voltage to the second electrode of the driving transistor by the sensing circuit in response to the control of the second gate line.

In some embodiment, the data writing circuit includes a first transistor; and the first transistor is turned on in response to a valid level signal provided from the first gate line to allow a path to be formed between the data line and the control electrode of the driving transistor.

In some embodiment, the sensing circuit includes a second transistor; and the second transistor is turned on in response to a valid level signal provided from the second gate line to allow a path to be formed between the signal sensing line and the second electrode of the driving transistor.

In some embodiment, the pixel circuit further includes a supply circuit; and the supply circuit is coupled to a supply terminal of an analog-to-digital converter and a reference voltage terminal, and is configured to write the second reference voltage provided by the reference voltage terminal to the signal sensing line during the sensing write stage and the sensing reset stage, and write a detection current provided by the supply terminal of the analog-to-digital converter to the signal sensing line during the sensing charging stage.

In some embodiment, the supply circuit includes a first switch and a second switch; and a path is formed between the analog-to-digital converter and the signal sensing line when the first switch is in a turn-on state, and a path is formed between the reference voltage terminal and the signal sensing line when the second switch is in a turn-on state.

A second aspect of the present disclosure provides a driving control method for a pixel circuit, wherein the pixel circuit includes a driving transistor, a data writing circuit, a sensing circuit, and a storage capacitor;

the data writing circuit is coupled to a first gate line, a data line and a control electrode of the driving transistor, respectively, the sensing circuit is coupled to a second gate line, a signal sensing line and a second electrode of the driving transistor, respectively, a first electrode of the driving transistor is coupled to a first voltage terminal, a first terminal of the storage capacitor is coupled to the control electrode of the driving transistor, and a second terminal of the storage capacitor is coupled to the second electrode of the driving transistor;

the driving control method includes:

during a sensing write stage, providing a test voltage equal to a sum of a first reference voltage and a threshold voltage of the driving transistor, by a source driving unit, to the data line, writing a first scanning signal at a valid level, by a first gate driving unit, to the first gate line so as to control the data writing circuit to write the test voltage to the control electrode of the driving transistor, and writing a second scanning signal at a valid level, by a second gate driving unit, to the second gate line so as to control the sensing circuit to write a second reference voltage to the second electrode of the driving transistor;

during a sensing sampling stage, continuing to provide the test voltage, by the source driving unit, to the data line, writing the first scanning signal at the valid level, by the first gate driving unit, to the first gate line so as to control the data writing circuit to continue writing the test voltage to the control electrode of the driving transistor, and writing a second scanning signal at an invalid level, by the second gate driving unit, to the second gate line so as to control the sensing circuit to stop writing a voltage to the second electrode of the driving transistor;

during a sensing reset stage, writing a first scanning signal at an invalid level, by the first gate driving unit, to the first gate line so as to control the data writing circuit to stop writing a voltage to the control electrode of the driving transistor, and writing the second scanning signal at the valid level, by the second gate driving unit, to the second gate line again so as to control the sensing circuit to write the second reference voltage to the second electrode of the driving transistor; and during a sensing charging stage, continuing to write the first scanning signal at the invalid level, by the first gate driving unit, to the first gate line so as to control the data writing circuit to stop writing a voltage to the control electrode of the driving transistor, and continuing to write the second scanning signal at the valid level, by the second gate driving unit, to the second gate line so as to control the sensing circuit to allow a current output from the second electrode of the driving transistor to flow to the signal sensing line, so as to charge the signal sensing line.

In some embodiment, the driving control method further includes, after the sensing charging stage:

during a data writing stage, providing the test voltage, by the source driving unit, to the data line, writing the first scanning signal at the valid level, by the first gate driving unit, to the first gate line so as to control the data writing circuit to write a compensated data voltage to the control electrode of the driving transistor, and writing the second scanning signal at the valid level, by the second gate driving unit, to the second gate line so as to control the sensing circuit to write the second reference voltage to the second electrode of the driving transistor;

during an internal compensation stage, continuing to provide the test voltage, by the source driving unit, to the data line, writing the first scanning signal at the valid level, by the first gate driving unit, to the first gate line so as to control the data writing circuit to continue writing the compensated data voltage to the control electrode of the driving transistor, and writing the second scanning signal at the invalid level, by the second gate driving unit, to the second gate line so as to control the sensing circuit to stop writing a voltage to the second electrode of the driving transistor; and during a continuous light emission stage, writing the first scanning signal at the invalid level, by the first gate driving unit, to the first gate line so as to control the data writing circuit to stop writing a voltage to the control electrode of the driving transistor, and continuing to write the second scanning signal at the invalid level, by the second gate driving unit, to the second gate line so as to control the sensing circuit to stop writing a voltage to the second electrode of the driving transistor.

A third aspect of the present disclosure provides a non-transitory computer-readable storage medium including a program stored therein, wherein when executed by a processor, the program controls the first gate driving unit, the second gate driving unit, and the source driving unit to implement the driving control method according to any one of the embodiments of the second aspect of the present disclosure.

BRIEF DESCRIPTION OF THE DRAWINGS

The accompanying drawings, which are included to provide a further understanding of the present disclosure and constitute a part of this specification, are for explaining the present disclosure together with the following exemplary embodiments, but not intended to limit the present disclosure. In the drawings.

DETAILED DESCRIPTION

Figure 1:
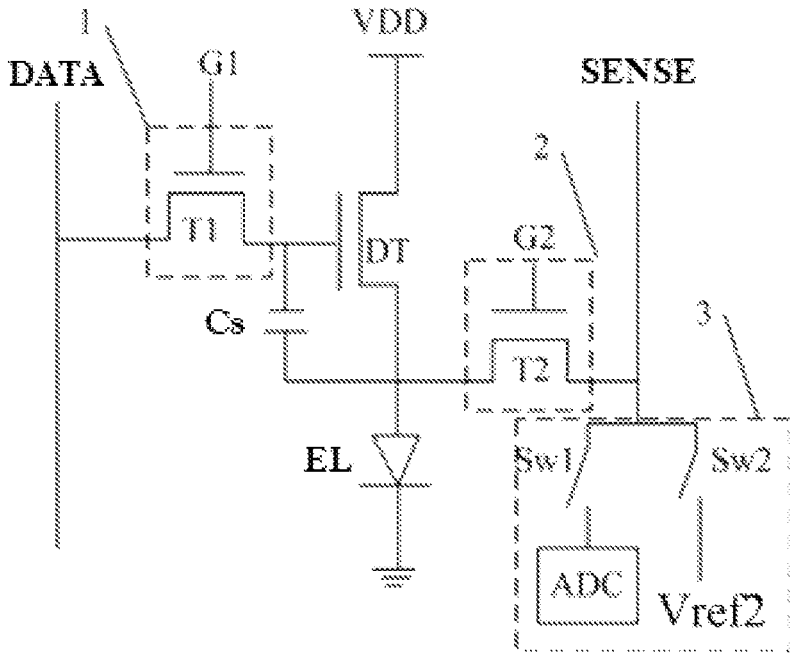
FIG. 1 is a schematic diagram showing a structure of a pixel circuit according to an embodiment of the present disclosure.

To enable one of ordinary skill in the art to better understand technical solutions of the present disclosure, the present disclosure will be further described below in detail with reference to the accompanying drawings and exemplary embodiments.

The present disclosure will now be described in more detail with reference to the accompanying drawings, in which like elements are denoted by like reference signs throughout. For purposes of clarity, various elements shown in the drawings may not necessarily be drawn to scale. Further, certain well-known elements may not be shown in the drawings.

Numerous specific details of the present disclosure, such as structures, materials, sizes (i.e., dimensions), treatment processes and techniques of components, are set forth in the following description to facilitate a more thorough understanding of the present disclosure. It will be understood by one of ordinary skill in the art that the technical solutions provided in the present disclosure may be implemented without these specific details.

As shown in FIG. 1, an embodiment of the present disclosure provides a pixel circuit having both an internal compensation function and an external compensation function. The pixel circuit may include a driving transistor DT, a data writing circuit 1, a sensing circuit 2, and a storage capacitor Cs.

The data writing circuit 1 is coupled to a first gate line G1, a data line DATA, and a control electrode (e.g., a gate electrode) of the driving transistor DT. The sensing circuit 2 is coupled to a second gate line G2, a signal sensing line SENSE, and a second electrode of the driving transistor DT. A first electrode of the driving transistor DT is coupled to a first voltage terminal, and the second electrode of the driving transistor DT is coupled to an anode of a light emitting device (e.g., an organic light emitting diode (OLED)) EL. A cathode of the light emitting device EL may be coupled to the ground, for example. A first terminal of the storage capacitor Cs is coupled to the control electrode of the driving transistor DT, and a second terminal of the storage capacitor Cs is coupled to the second electrode of the driving transistor DT. For example, the first voltage terminal provides a first operating voltage VDD (i.e., the reference sign "VDD" may represent the first voltage terminal or the first operating voltage herein). In an embodiment, the first operating voltage VDD may be a positive voltage capable of driving the light emitting device EL to normally emit light. In an embodiment, the second electrode of the driving transistor DT may be a source electrode of the driving transistor DT.

An operation process of the pixel circuit may include the following three stages: 1) a threshold voltage sensing stage; 2) a k-value detection stage; and 3) an internal compensation display stage.

For example, the threshold voltage sensing stage is for sensing a threshold voltage Vth of the driving transistor through the signal sensing line SENSE, and the detailed sensing process thereof is conventional in the art and will not be described in detail here.

The k-value detection stage may also be referred to as an "electron mobility sensing stage", and is for sensing the current electron mobility of the driving transistor, so as to determine an offset of (or a difference in) the electron mobility of the driving transistor. Then, a data voltage is adjusted (or compensated) according to the offset of the electron mobility, so as to compensate an offset of a driving current output from the driving transistor caused by the offset of the electron mobility. That is, the k-value detection stage may be an external compensation method.

The internal compensation display stage is for changing waveforms of scanning signals provided by the first gate line G1 and the second gate line G2, such that a charging time of the gate electrode of the driving transistor DT is longer than a charging time of the second electrode of the driving transistor DT by a predetermined time period. During this time difference (i.e., the predetermined time period), the driving transistor DT may output a current to charge the second electrode, and a gate-source voltage Vgs of the driving transistor DT may decrease. For example, the output current of the driving transistor DT is large, a voltage variation amount of the second electrode of the driving transistor DT is also large, and a variation amount of the gate-source voltage Vgs of the driving transistor DT is also large. The larger the variation amount of the gate-source voltage Vgs of the driving transistor DT is, the larger a decrease in the driving current output from the driving transistor DT during a light emitting process is (i.e., the larger a decrease in light emitting luminance of the light emitting device in a subsequent light emitting process is), thereby achieving the compensation effect on the driving transistor DT.

However, the inventors of the present inventive concept have found in practical applications that, since a resistance-capacitance delay (RC delay) occurs on each of the first gate line G1 and the second gate line G2, differences between the charging times of the gate electrodes of the driving transistors DT and the charging times of the second electrodes of the driving transistors DT in different pixel units (or in different pixel circuits, because the pixel units are generally in a one-to-one correspondence with the pixel circuits) are different during the internal compensation display stage. Specifically, a difference between the charging time of the gate electrode of the driving transistor DT and the charging time of the second electrode of the driving transistor DT in a pixel unit closer to a gate driving unit DRVG (see FIG. 10 and the following description) is greater than a difference between the charging time of the gate electrode of the driving transistor DT and the charging time of the second electrode of the driving transistor DT in a pixel unit farther away from the gate driving unit DRVG.

Exemplary description will be made below in conjunction with a specific circuit.

For example, as shown in FIG. 1, the data writing circuit 1 may include a first transistor T1. The first transistor T1 is turned on in response to a valid level signal provided (or supplied) from the first gate line G1, such that a path (e.g., electric path) is formed between the data line DATA and the control electrode of the driving transistor DT.

The sensing circuit 2 may include a second transistor T2. The second transistor T2 is turned on in response to a valid level signal provided from the second gate line G2, such that a path (e.g., electric path) is formed between the signal sensing line SENSE and the second electrode of the driving transistor DT.

Further, the pixel circuit shown in FIG. 1 may further include a supply circuit 3. The supply circuit 3 is coupled to a supply terminal of an analog-to-digital converter ADC and a reference voltage terminal, and is configured to write (e.g., input) a second reference voltage Vref2 provided by the reference voltage terminal to the signal sensing line SENSE during a sensing write stage t1' and a sensing reset stage t3' (see FIG. 6), and write a detection current provided by the supply terminal of the analog-to-digital converter ADC to the signal sensing line SENSE during a sensing charging stage t4' (see FIG. 6). In an embodiment, the second reference voltage Vref2 may be equal to 0 (zero) volts.

For example, the supply circuit 3 may include a first switch Sw1 and a second switch Sw2. For example, when the first switch Sw1 is turned on, a path (e.g., electric path) is formed between the analog-to-digital converter ADC and the signal sensing line SENSE, and when the second switch Sw2 is turned on, a path (e.g., electric path) is formed between the reference voltage terminal and the signal sensing line SENSE. The first switch Sw1 and the second switch Sw2 may be coupled in parallel to the signal sensing line SENSE, and may be configured to not be turned on at the same time. In an embodiment, the supply circuit 3 may further include the analog-to-digital converter ADC and the reference voltage terminal. In an embodiment, the pixel circuit may further include the first gate line G1, the data line DATA, the signal sensing line SENSE, the second gate line G2, and the first voltage terminal VDD.

In an embodiment of the present disclosure, an example in which all transistors of the pixel circuit are N-type transistors is described. In this case, the valid level signal of each transistor (i.e., a signal that turns on the transistor) is a high level signal, and the operation process of the pixel circuit may include the following first to third steps.

In the first step, a threshold voltage Vth of the driving transistor DT is obtained by a conventional threshold voltage sensing method.

Figure 2:
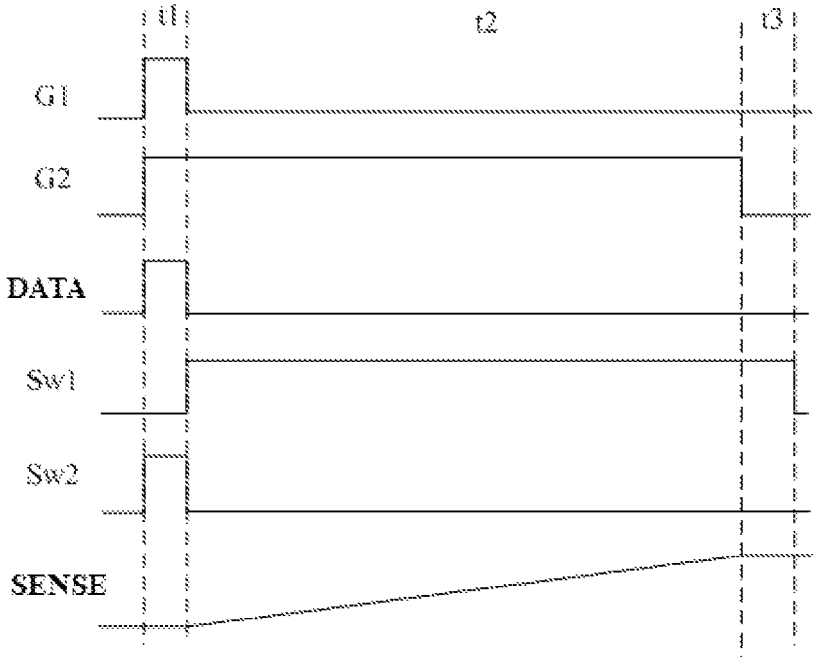
FIG. 2 is a schematic timing diagram of a k-value detection stage for a pixel circuit according to an embodiment of the present disclosure.

In the second step, a k-value of the pixel circuit is detected (i.e., an external compensation is performed). For example, the timing for detecting the k-value of the pixel circuit is shown in FIG. 2. A data voltage of the data line DATA is written to the control electrode of the driving transistor DT, and the data voltage may be a sum V1 of a first reference voltage Vref1 and the threshold voltage Vth of the driving transistor DT (i.e., V1=Vref1+Vth), where the first reference voltage Vref1 is a preset fixed voltage value, and the threshold voltage of the driving transistor DT is the threshold voltage Vth obtained in the first step. The signal sensing line SENSE writes the second reference voltage Vref2 to the second electrode of the driving transistor DT through the sensing circuit 2. Thus, the gate-source voltage Vgs of the driving transistor DT is Vgs=Vref1+Vth−Vref2. The threshold voltage Vth is a positive value in consideration of that the driving transistor DT is an N-type transistor in the present embodiment, and the preset first reference voltage Vref1 is greater than the second reference voltage Vref2 to ensure that the driving transistor may be turned on. It should be noted that, when the driving transistor is of P-type, the threshold voltage Vth is a negative value, and the preset first reference voltage Vref1 is smaller than the second reference voltage Vref2.

Further, since a charging current I is calculated according to the formula of $I=k(Vgs-Vth)^2$, the charging current I of the pixel circuit is $I=k(Vref1-Vref2)^2$. In a case where Vref1−Vref2 is a fixed value, the charging current depends on only the k-value, i.e., a charging voltage of the second electrode of the driving transistor DT depends on only the k-value. Thus, the k-value may be measured according to the charging voltage of the second electrode of the driving transistor DT, and the data voltage may be externally compensated according to the measured k-value.

The k-value is a constant, and a magnitude of the k-value depends on a width-length ratio of a channel and an electron mobility of the driving transistor. Since the width-length ratio of the channel is a fixed value, an offset of the electron mobility of the driving transistor may be represented by an offset of the k-value.

In the third step, internal compensation display is performed on the pixel circuit according to the data voltage obtained by the external compensation (i.e., the compensated data voltage).

Figure 3:
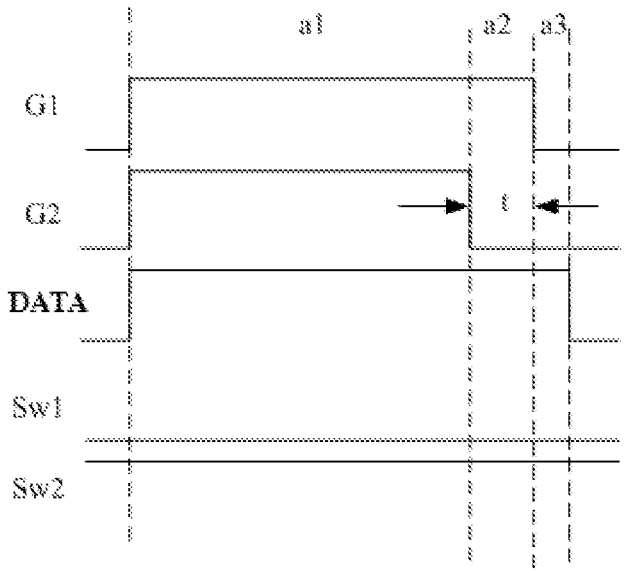
FIG. 3 is a schematic timing diagram of an internal compensation display stage according to an embodiment of the present disclosure.

Specifically, referring to FIG. 3, compensated data (e.g., the compensated data voltage) obtained by the external compensation is written into the data line DATA in real time, a signal of the data line DATA is written into the control electrode of the driving transistor DT, and the signal sensing line SENSE writes a signal (e.g., the second reference voltage Vref2) into the second electrode of the driving transistor DT. The signal sensing line SENSE is decoupled (e.g., disconnected) from the second electrode of the driving transistor DT, i.e., the second transistor T2 is turned off earlier than the first transistor T1 (a time period by which the second transistor T2 is turned off earlier than the first transistor T1 is a time period t as shown in FIG. 3). Then, a driving current is continuously written to the second electrode of the driving transistor DT, such that a voltage of the second electrode of the driving transistor DT will increase, and the gate-source voltage Vgs of the driving transistor DT will decrease. Therefore, during a light emitting process of the organic light emitting diode after the data line DATA is decoupled from the control electrode of the driving transistor DT (i.e., after the first transistor T1 is turned off), the luminance (or brightness) of the organic light emitting diode is also decreased accordingly, thereby achieving compensation for the display current.

Further, each of the driving transistor DT, the first transistor T1, and the second transistor T2 may be a thin film transistor (TFT). If the driving current flowing through the driving transistor DT, that is a TFT, is large, an increase in voltage of the second electrode of the driving transistor DT is also large, and a decrease in luminance (or brightness) is also large. In addition, the longer the time period by which the second transistor T2 is turned off earlier than the first transistor T1 (i.e., the larger the time period t as shown in FIG. 3) is, the larger the increase in the voltage of the second electrode of the driving transistor DT is, the larger the decrease in the gate-source voltage Vgs of the driving transistor DT is, and the larger the decrease in luminance (or brightness) of the organic light emitting diode is.

Figure 4:
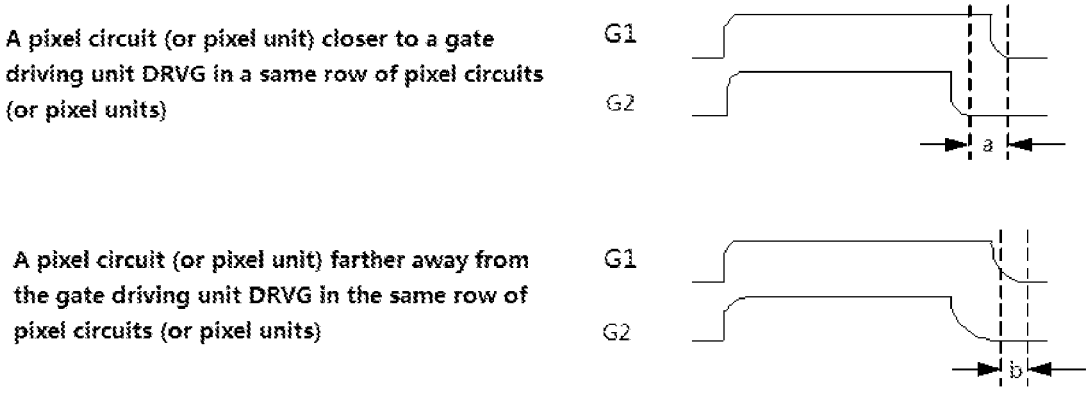
FIG. 4 is a schematic diagram illustrating the principle that a difference in compensation time is present between different pixel circuits during an internal compensation display stage according to an embodiment of the present disclosure.
Figure 10:
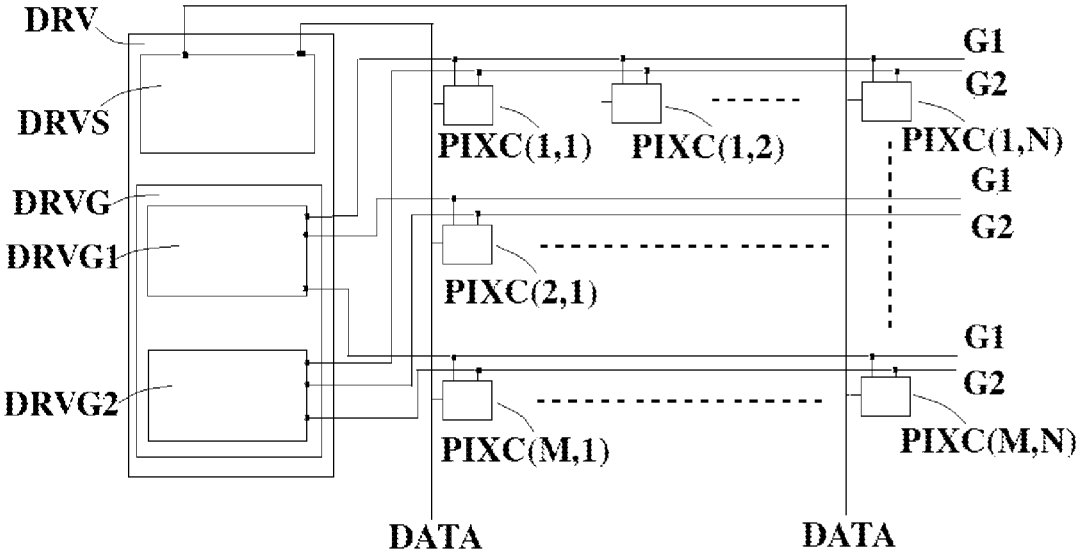
FIG. 10 is a schematic diagram showing a connection relationship between a driver and an array of pixel circuits according to an embodiment of the present disclosure.

The inventors of the present inventive concept have found that the above-described compensation process of the pixel circuit may have the following problem. As shown in FIGS. 4 and 10, in the respective pixel circuits in a same row, since the resistance-capacitance delay of a pixel circuit (e.g., the pixel circuit PIXC (1, N)) farther away from the gate driving unit DRVG (see FIG. 10) is greater than the resistance-capacitance delay of a pixel circuit (e.g., the pixel circuit PIXC (1, 1)) closer to the gate driving unit DRVG, when the second transistor T2 is turned off and the first transistor T1 is turned on (i.e., during a time period in which the first transistor T1 is turned off later than the second transistor T2), the turn-off of the second transistor T2 of the pixel circuit farther away from the gate driving unit DRVG is also delayed. Thus, a turn-off time of the second transistor T2 of the pixel circuit farther away from the gate driving unit DRVG is later than a turn-off time of the second transistor T2 of the pixel circuit closer to the gate driving unit DRVG, i.e., a time period (e.g., the time period b as shown in FIG. 4) by which the turn-off of the first transistor T1 of the pixel circuit farther away from the gate driving unit is delayed is shorter than a time period (e.g., the time period a as shown in FIG. 4) by which the turn-off of the first transistor T1 of the pixel circuit closer to the gate driving unit is delayed. Accordingly, an increase in the voltage of the second electrode of the driving transistor DT of the pixel circuit farther away from the gate driving unit is smaller than an increase in the voltage of the second electrode of the driving transistor DT of the pixel circuit closer to the gate driving unit, and thus a pixel farther away from the gate driving unit has a greater luminance (or brightness) than that of a pixel closer to the gate driving unit, resulting in a problem of poor compensation effect.

The following embodiments of the present disclosure at least address the problem of poor compensation effect resulted from the driving method for the pixel circuit according to the above embodiments.

Figure 5:
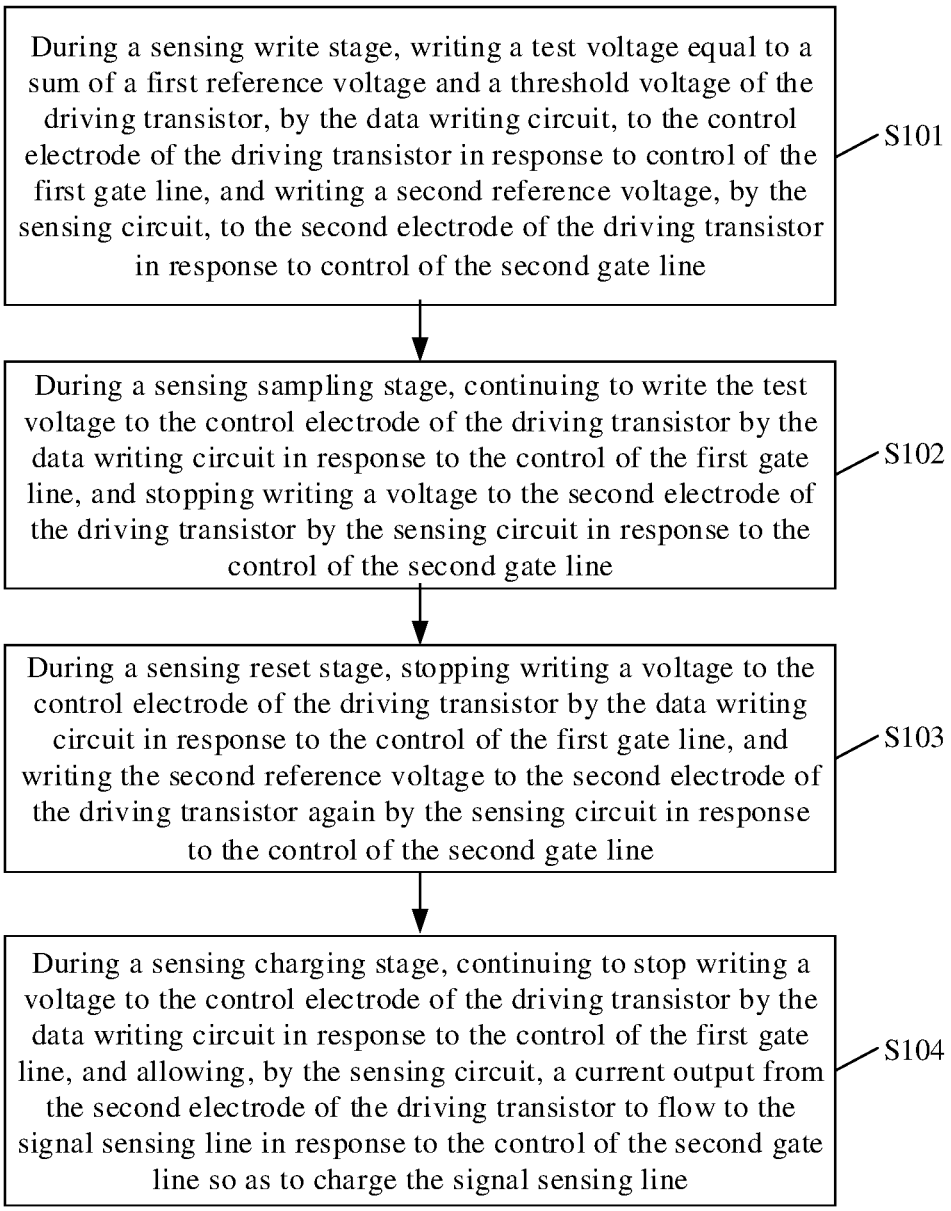
FIG. 5 is a schematic flowchart of a driving method for a pixel circuit according to an embodiment of the present disclosure.
Figure 6:
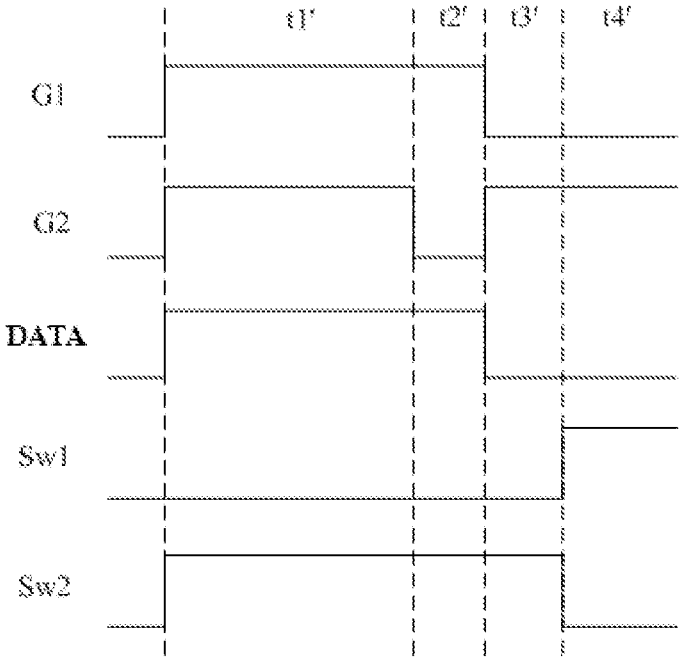
FIG. 6 is a schematic timing diagram of a k-value detection stage for a pixel circuit according to an embodiment of the present disclosure.

As shown in FIGS. 5 and 6, in order to at least solve the problem of poor compensation effect, an embodiment of the present disclosure provides a driving method for a pixel circuit. For example, as shown in FIG. 1, the pixel circuit includes the driving transistor DT, the data writing circuit 1, the sensing circuit 2, and the storage capacitor Cs. The data writing circuit 1 is coupled to the first gate line G1, the data line DATA, and the control electrode of the driving transistor DT, respectively. The sensing circuit 2 is coupled to the second gate line G2, the signal sensing line SENSE, and the second electrode of the driving transistor DT, respectively. The first electrode of the driving transistor DT is coupled to the first voltage terminal. The first terminal of the storage capacitor Cs is coupled to the control electrode of the driving transistor DT, and the second terminal of the storage capacitor Cs is coupled to the second electrode of the driving transistor DT.

In an embodiment of the present disclosure, the driving method for the pixel circuit includes a k-value detection stage (i.e., an external compensation method), and may include, for example, the following steps S101 to S104.

In step S101, during a sensing write stage t1', the data writing circuit 1 writes a test voltage V1 (e.g., V1=Vref1+Vth, as described above, the first reference voltage Vref1 is a preset fixed voltage value) to the control electrode of the driving transistor DT in response to the control of the first gate line G1, and the sensing circuit 2 writes the second reference voltage Vref2 to the second electrode of the driving transistor DT in response to the control of the second gate line G2, the test voltage V1 being equal to the sum of the first reference voltage Vref1 and the threshold voltage Vth of the driving transistor DT. For example, when the driving transistor is an N-type transistor, the first reference voltage Vref1 is greater than the second reference voltage Vref2, whereas when the driving transistor is a P-type transistor, the first reference voltage Vref1 is less than the second reference voltage Vref2.

That is, during the sensing write stage t1', the voltage Vg of the control electrode of the driving transistor DT is the sum of the first reference voltage Vref1 and the threshold voltage Vth of the driving transistor DT, i.e., Vg=Vref1+Vth; and the voltage of the second electrode (e.g., the source electrode) of the driving transistor DT is the second reference voltage Vref2. Thus, the gate-source voltage Vgs of the driving transistor DT is Vgs=Vref1+Vth−Vref2.

In step S102, during a sensing sampling stage t2', the data writing circuit 1 continues to write the test voltage to the control electrode of the driving transistor DT in response to the control of the first gate line G1, and the sensing circuit 2 stops writing a voltage to the second electrode of the driving transistor DT in response to the control of the second gate line G2.

At the initial time of the sensing sampling stage t2', a driving current I output from the driving transistor is as follows:

$$I=k(V\text{ref1}+Vth-V\text{ref2}-Vth)^2$$

$$=k(V\text{ref1}-V\text{ref2})^2.$$

That is, in a case without considering the influence of the k-value, since the value of Vref1−Vref2 is fixed, when pixel units on a display substrate that are in a same row but in different columns enter the sensing sampling stage t2', initial voltages of the second electrodes of the driving transistors of the pixel units are the same, and currents output from the driving transistors of the pixel units are the same.

During the sensing sampling stage t2', the voltage of the second electrode of the driving transistor DT will be changed because the sensing circuit 2 stops writing a voltage to the second electrode of the driving transistor DT. For example, assuming that at the end of the sensing sampling stage t2', the voltage of the second electrode of the driving transistor DT is increased by ΔV (this process is similar to the increase process of the voltage of the second electrode of the driving transistor DT in the third step of the compensation process for the pixel circuit as described above), the voltage Vg of the control electrode of the driving transistor DT is Vg=Vref1+Vth, and the voltage Vs of the second electrode (e.g., the source electrode) of the driving transistor DT is Vs=Vref2+ΔV. Thus, the gate-source voltage Vgs of the driving transistor DT is Vgs=Vref1+Vth−Vref2−ΔV.

During the sensing sampling stage t2', due to the influence of the RC delay on the first gate line G1 and the second gate line G2, in a same row of pixel circuits (or pixel units), the actual time that a pixel circuit closer to the gate driving unit DRVG is in the sensing sampling stage t2' is greater than the actual time that a pixel circuit farther away from the gate driving unit DRVG is in the sensing sampling stage t2' (see FIG. 4). Therefore, the increase (i.e., ΔV) in the voltage of (or at) the second electrode of the driving transistor DT closer to the gate driving unit DRVG is larger, and the increase (i.e., ΔV) in the voltage of the second electrode of the driving transistor DT farther away from the gate driving unit DRVG is smaller (in other words, the ΔV corresponding to a pixel circuit closer to the gate driving unit when this pixel circuit undergoes the sensing sampling stage t2' is larger, and the ΔV corresponding to a pixel circuit farther away from the gate driving unit when this pixel circuit undergoes the sensing sampling stage t2' is smaller). That is, the gate-source voltage of a driving transistor DT closer to the gate driving unit is smaller than the gate-source voltage of a driving transistor DT farther away from the gate driving unit. Thus, the magnitudes of plural ΔV may represent the degrees of influence of the RC delay on different pixel circuits.

In step S103, during a sensing reset stage t3', the data writing circuit 1 stops writing a voltage to the control electrode of the driving transistor DT in response to the control of the first gate line G1, and the sensing circuit 2 writes the second reference voltage Vref2 to the second electrode of the driving transistor DT again in response to the control of the second gate line G2.

That is, the sensing circuit 2 writes the second reference voltage Vref to the second electrode of the driving transistor DT to reset the second electrode of the driving transistor DT. Since the data writing circuit 1 is decoupled (e.g., disconnected) from the control electrode of the driving transistor DT, the control electrode of the driving transistor DT is in a floating state. Further, the gate-source voltage of the driving transistor DT remains unchanged during the resetting of the control electrode of the driving transistor DT, due to the coupling effect of the storage capacitor Cs.

In step S104, during a sensing charging stage t4', the data writing circuit 1 continues to stop writing a voltage to the control electrode of the driving transistor DT in response to the control of the first gate line G1, and the sensing circuit 2 allows the current output from the second electrode of the driving transistor DT to flow to the signal sensing line SENSE in response to the control of the second gate line G2, to charge the signal sensing line SENSE.

During the sensing charging stage, the voltage at the second electrode of the driving transistor DT and the voltage at the signal sensing line may vary, but the gate-source voltage Vgs=Vref1+Vth−Vref2−ΔV of the driving transistor DT remains unchanged. Thus, the driving transistor DT outputs a driving current I having a constant magnitude:

$$I = k(Vgs - Vth)^2 = k(Vref1 + Vth - Vref2 - \Delta V - Vth)^2 = k(Vref1 - Vref2 - \Delta V)^2$$

The voltage of the second electrode of the driving transistor DT is changed from Vref2, and it is assumed that the voltage of the second electrode of the driving transistor DT is changed to ΔV' at the end of the sensing charging stage t4'. In this case, the ΔV' may reflect not only an offset of the electron mobility of the driving transistor, but also the degree of influence of the RC delay on a pixel circuit.

Specifically, the larger the voltage ΔV' of the second electrode of the driving transistor DT at the end of the sensing charging stage t4' is, the larger the k-value finally calculated is. In a subsequent display stage, the data voltage provided by the data line DATA is adjusted according to the calculated k-value to ensure that the pixels have a same brightness. The current output from the second electrode of the driving transistor DT may be allowed to flow to the signal sensing line SENSE, so as to charge the signal sensing line SENSE. An external chip may determine a value for compensating for the data voltage according to the charged voltage ΔV' on the signal sensing line.

In practical applications, in a case without considering the influence of the k-value, in a same row of pixel circuits, for a pixel circuit closer to the gate driving unit DRVG, the larger a change amount ΔV of the gate-source voltage Vgs of the driving transistor during the sensing sampling stage t2' is, the smaller the driving current during the sensing charging stage t4' is, the smaller the ΔV' obtained after the sensing charging stage t4' is ended is, and the smaller the calculated k-value is. When an external compensation is performed in real time based on the k-value, a compensation amount of the data voltage may be increased for a small k-value, such that a decrease in brightness caused by the RC delay during a display process may be offset (or compensated). Similarly, for a pixel circuit farther away from the gate driving unit DRVG, the smaller the change amount ΔV of the gate-source voltage Vgs of the driving transistor during the sensing sampling stage t2' is, the larger the driving current during the sensing charging stage t4' is, the larger the ΔV' obtained after the end of the sensing charging stage t4' is, and the larger the calculated k-value is. Therefore, the compensation amount of the data voltage may be decreased for a large k-value when a compensation is performed in real time based on the k-value. It should be noted that, after the k-value is obtained, the process of compensating the data voltage in real time according to the k-value is conventional in the art, and therefore, detailed description thereof is omitted herein.

In the driving method for the pixel circuit according to the foregoing embodiments of the present disclosure, the k-value is obtained by detection, and then the data voltage of the data line DATA during a subsequent display process is adjusted according to the k-value, such that in a same row of pixel circuits, a driving current of a pixel circuit closer to the gate driving unit DRVG is the same as a driving current of a pixel circuit farther away from the gate driving unit DRVG, thereby avoiding the compensation defect caused by different resistance-capacitance delays of the pixel circuits in the related art, and ensuring that all of the pixel circuits have a same display brightness.

In some embodiments, the data writing circuit 1 includes the first transistor T1. The first transistor T1 may be turned on in response to a valid level signal provided from the first gate line G1, such that a path is formed between the data line DATA and the control electrode of the driving transistor DT.

In some embodiments, the sensing circuit 2 includes the second transistor T2. The second transistor T2 may be turned on in response to a valid level signal provided from the second gate line G2, such that a path is formed between the signal sensing line SENSE and the second electrode of the driving transistor DT.

In some embodiments, the pixel circuit further includes the supply circuit 3. The supply circuit 3 is coupled to the supply terminal of the analog-to-digital converter ADC and the reference voltage terminal, respectively, and is configured to write the second reference voltage Vref2 provided by the reference voltage terminal to the signal sensing line SENSE during the sensing write stage t1' and the sensing reset stage t3', and write the detection current provided by the supply terminal of the analog-to-digital converter ADC to the signal sensing line SENSE during the sensing charging stage t4'.

In some embodiments, the supply circuit 3 includes the first switch Sw1 and the second switch Sw2. Each of the first switch Sw1 and the second switch Sw2 may be turned on or off under the control of a driver DRV (see FIG. 10). For example, when the first switch Sw1 is in a turn-on state, a path is formed between the analog-to-digital converter ADC and the signal sensing line SENSE, and when the second switch Sw2 is in a turn-on state, a path is formed between the reference voltage terminal and the signal sensing line SENSE.

As can be seen from the timing illustrated in FIG. 6, during the sensing write stage t1', both the first transistor T1 and the second transistor T2 are in a turn-on state, the first switch Sw1 is in a turn-off state, and the second switch Sw2 is in a turn-on state. During the sensing sampling stage t2', the first transistor T1 is in a turn-on state, the second transistor T2 is in a turn-off state, the first switch Sw1 is in a turn-off state, and the second switch Sw2 is in a turn-on state. During the sensing reset stage t3', the first transistor T1 is in a turn-off state, the second transistor T2 is in a turn-on state, the first switch Sw1 is in a turn-off state, and the second switch Sw2 is in a turn-on state. During the sensing charging stage t4', the first transistor T1 is in a turn-off state, the second transistor T2 is in a turn-on state, the first switch Sw1 is in a turn-on state, and the second switch Sw2 is in a turn-off state. The detailed operation process thereof may be referred to the foregoing description.

It should be noted that the pixel circuit shown in FIG. 1 is only one alternative in the embodiments of the present disclosure, but the present disclosure is not limited thereto. For example, the pixel circuit according to an embodiment of the present disclosure may also have other circuit structures, for example, each of the transistors shown in FIG. 1 may alternatively be a P-type transistor, and detailed description thereof is omitted here.

Figure 7:
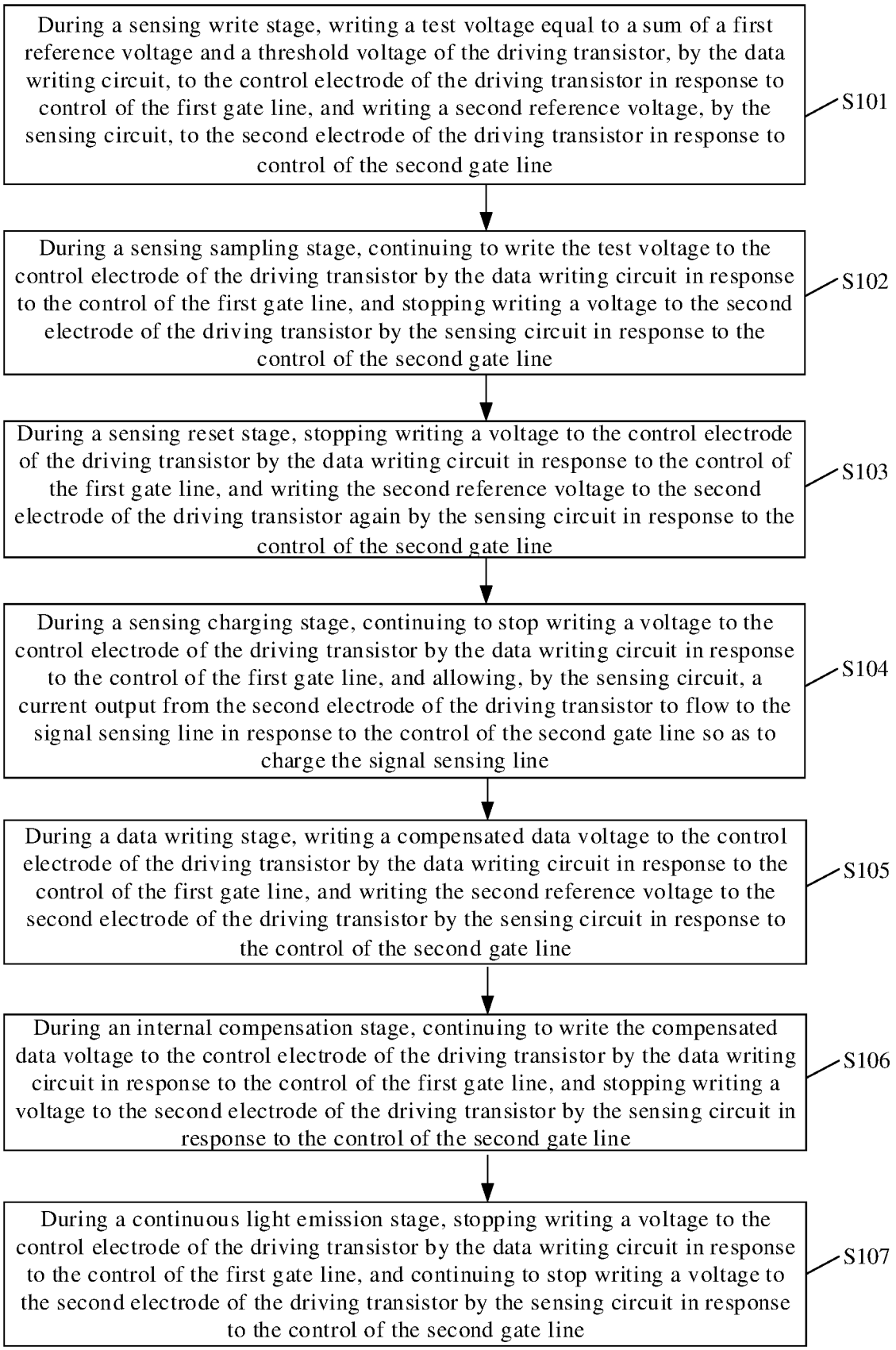
FIG. 7 is a schematic flowchart of another driving method for a pixel circuit according to an embodiment of the present disclosure.

Referring to FIGS. 3 and 7, an embodiment of the present disclosure provides another driving method of the pixel circuit, and this driving method may include not only the above-described steps S101 to S104 (as shown in FIG. 5), but also the following steps S105 to S107 after step S104. To avoid repetition, only steps S105 to S107 will be described in detail below.

In step S105, during a data writing stage a1, the data writing circuit 1 writes the compensated data voltage to the control electrode of the driving transistor DT in response to the control of the first gate line G1, and the sensing circuit 2 writes the second reference voltage Vref2 to the second electrode of the driving transistor DT in response to the control of the second gate line G2.

For example, the "compensated data voltage" is a data voltage compensated according to the k-value.

In step S106, during an internal compensation stage a2, the data writing circuit 1 continues to write the compensated data voltage to the control electrode of the driving transistor DT in response to the control of the first gate line G1, and the sensing circuit 2 stops writing a voltage to the second electrode of the driving transistor DT in response to the control of the second gate line G2.

An internal compensation for the pixel circuit is achieved by the internal compensation stage a2. It should be noted that, since the compensation for the RC delay of each of the first gate line G1 and the second gate line G2 is already implemented in the process of detecting the k-value in steps S101 to S104, the problem of nonuniform compensation caused by the RC delay may be effectively reduced or even eliminated during the internal compensation stage a2.

In step S107, during a continuous light emission stage a3, the data writing circuit 1 stops writing a voltage to the control electrode of the driving transistor DT in response to the control of the first gate line G1, and the sensing circuit 2 continuously stops writing a voltage (e.g., the second reference voltage Vref2) to the second electrode of the driving transistor DT in response to the control of the second gate line G2.

It can be seen from the timing shown in FIG. 3 that, during the data writing stage a1, the first transistor T1 and the second transistor T2 are both in the turn-on state, the first switch Sw1 is in the turn-off state, and the second switch Sw2 is in the turn-on state. During the internal compensation stage a2, the first transistor T1 is in the turn-on state, the second transistor T2 is in the turn-off state, the first switch Sw1 is in the turn-off state, and the second switch Sw2 is in the turn-on state. During the continuous light emission stage a3, the first transistor T1 is in the turn-off state, the second transistor T2 is in the turn-off state, the first switch Sw1 is in the turn-off state, and the second switch Sw2 is in the turn-on state. The detailed operation process may be referred to the foregoing description.

The stages shown in FIG. 6 have been described in detail above. It should be understood that the stage t1 shown in FIG. 2 may be equivalent to the stages t1', t2' and t3' shown in FIG. 6, and the stages t2 and t3 shown in FIG. 2 may be equivalent to the stage t4' shown in FIG. 6.

It is to be understood that the driving method as shown in FIG. 5 or FIG. 7 may be used for, for example, an array of pixel circuits (or pixel units). The array may include, for example, M rows and N columns, and include pixel circuits (or pixel units) PIXC (1, 1) to PIXC (M, N). In an embodiment, a display panel may include the array of the pixel circuits (or pixel units) and a driver DRV for driving the array of the pixel circuits (or pixel units) to display, as shown in FIG. 10. The driver DRV may include a source driving unit DRYS and the gate driving unit DRVG. The gate driving unit DRVG may include a first gate driving unit DRVG1 and a second gate driving unit DRVG 2. The source driving unit DRYS may provide signals such as the test voltage V1, the compensated data voltage, etc. as described herein to the data line DATA. The first gate driving unit DRVG1 may provide a voltage for turning on or off the first transistor T1 to the first gate line G1. The second gate driving unit DRVG2 may provide a voltage for turning on or off the second transistor T2 to the second gate line G2. In an embodiment, the driver DRV may be an integrated circuit (IC) having the related functions described in the present disclosure.

Corresponding to the driving method for the array of pixel circuits (or pixel units) shown in FIG. 5 or 7, embodiments of the present disclosure further provide driving control methods, which may be applied to the driver DRV, for the pixel circuits, as described below.

Figure 8:
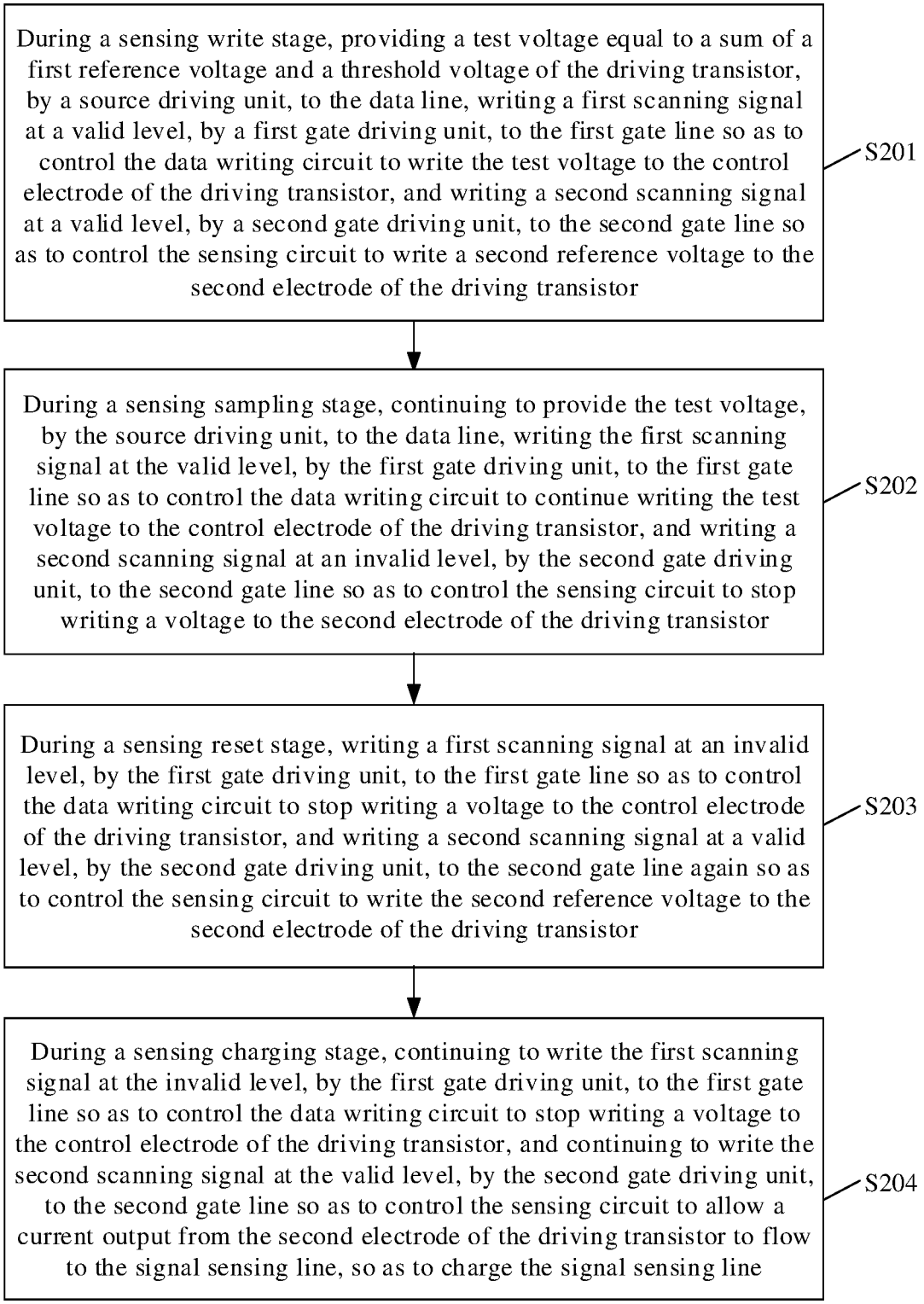
FIG. 8 is a schematic flowchart of a driving control method for a pixel circuit according to an embodiment of the present disclosure.

Referring to FIG. 8, the present embodiment provides a driving control method for the pixel circuit. For example, as shown in FIG. 1, the pixel circuit includes the driving transistor DT, the data writing circuit 1, the sensing circuit 2, and the storage capacitor Cs. The data writing circuit 1 is coupled to the first gate line G1, the data line DATA, and the control electrode of the driving transistor DT, respectively. The sensing circuit 2 is coupled to the second gate line G2, the signal sensing line SENSE, and the second electrode of the driving transistor DT, respectively. The first electrode of the driving transistor DT is coupled to the first voltage terminal. The first terminal of the storage capacitor Cs is coupled to the control electrode of the driving transistor DT, and the second terminal of the storage capacitor Cs is coupled to the second electrode of the driving transistor DT.

The driving control method for the pixel circuit may include the following steps S201 to S204, and may be referred to the timing diagram shown in FIG. 6.

In step S201, during the sensing write stage t1', the source driving unit DRVS provides the test voltage V1 to the data line DATA, the first gate driving unit DRVG1 writes a first scanning signal at a valid level (i.e., a level capable of turning on a related transistor) to the first gate line G1 so as to control the data writing circuit 1 to write the test voltage V1 to the control electrode of the driving transistor DT, and the second gate driving unit DRVG2 writes a second scanning signal at a valid level to the second gate line G2 so as to control the sensing circuit 2 to write the second reference voltage Vref2 to the second electrode of the driving transistor DT.

For example, the test voltage V1 is equal to the sum of the first reference voltage Vref1, which is a fixed value set in advance, and the threshold voltage Vth of the driving transistor DT.

In step S202, during the sensing sampling stage t2', the source driving unit DRVS continues to provide the test voltage V1 to the data line DATA, the first gate driving unit DRVG1 writes the first scanning signal at the valid level to the first gate line G1 so as to control the data writing circuit 1 to continue to write the test voltage V1 to the control electrode of the driving transistor DT, and the second gate driving unit DRVG2 writes a second scanning signal at an invalid level to the second gate line G2 so as to control the sensing circuit 2 to stop writing a voltage to the second electrode of the driving transistor DT.

In step S203, during the sensing reset stage t3', the first gate driving unit DRVG1 writes a first scanning signal at an invalid level to the first gate line G1 so as to control the data writing circuit 1 to stop writing a voltage to the control electrode of the driving transistor DT, and the second gate driving unit DRVG2 writes the second scanning signal at a valid level to the second gate line G2 again so as to control the sensing circuit 2 to write the second reference voltage Vref2 to the second electrode of the driving transistor DT.

In step S204, during the sensing charging stage t4', the first gate driving unit DRVG1 continues to write the first scanning signal at an invalid level to the first gate line G1 so as to control the data writing circuit 1 to stop writing a voltage to the control electrode of the driving transistor DT, and the second gate driving unit DRVG2 continues to write the second scanning signal at a valid level to the second gate line G2 so as to control the sensing circuit 2 to write the second reference voltage Vref2 to the second electrode of the driving transistor DT.

For the detailed description of the steps S201 to S204, reference may be made to the detailed description of the steps S101 to S104 according to the foregoing embodiments. Thus, the detailed description of the steps S201 to S204 is omitted here.

Figure 9:
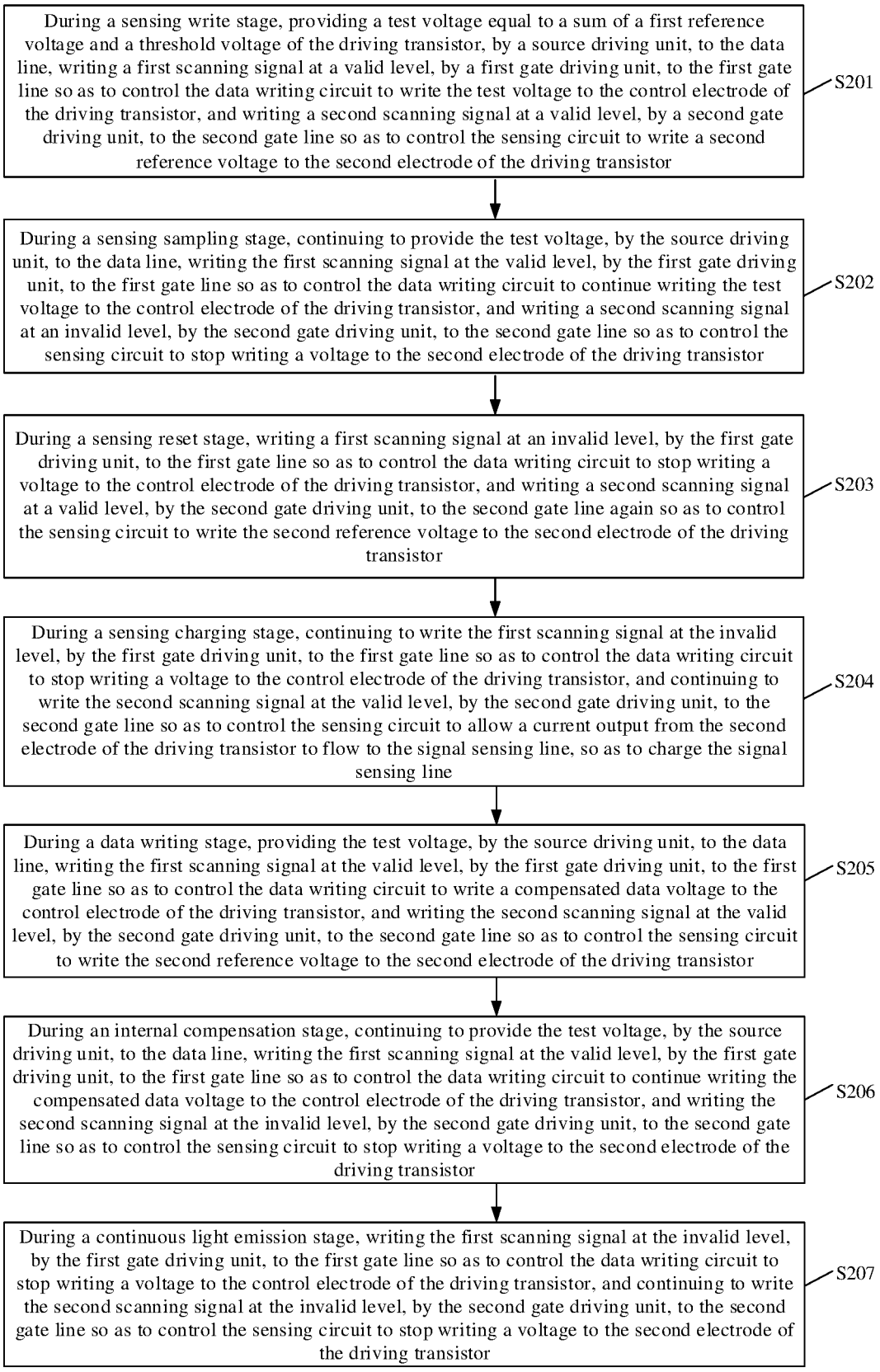
FIG. 9 is a schematic flowchart of another driving control method for a pixel circuit according to an embodiment of the present disclosure.

Referring to FIG. 9, the present embodiment provides another driving control method for the pixel circuit, and this driving control method may include not only steps S201 to S204 (as shown in FIG. 8) according to the above embodiment, but also the following steps S205 to S207 after step S204. The timing diagram of steps S205 to S207 may be similar to that shown in FIG. 3.

In step S205, during the data writing stage a1, the source driving unit DRVS provides the test voltage V1 to the data line DATA (e.g., the test voltage V1 is equal to the sum of the first reference voltage Vref1, which is a preset fixed value, and the threshold voltage Vth of the driving transistor DT), the first gate driving unit DRVG1 writes a first scanning signal at a valid level to the first gate line G1 so as to control the data writing circuit 1 to write the compensated data voltage to the control electrode of the driving transistor DT, and the second gate driving unit DRVG2 writes a second scanning signal at a valid level to the second gate line G2 so as to control the sensing circuit 2 to write the second reference voltage Vref2 to the second electrode of the driving transistor DT.

In step S206, during the internal compensation stage a2, the source driving unit DRVS continues to provide the test voltage V1 to the data line DATA, the first gate driving unit DRVG1 writes the first scanning signal at a valid level to the first gate line G1 so as to control the data writing circuit 1 to continue writing the compensated data voltage to the control electrode of the driving transistor DT, and the second gate driving unit DRVG2 writes a second scanning signal at an invalid level to the second gate line G2 so as to control the sensing circuit 2 to stop writing a voltage to the second electrode of the driving transistor DT.

In step S207, during the continuous light emission stage a3, the first gate driving unit DRVG1 writes a first scanning signal at an invalid level to the first gate line G1 so as to control the data writing circuit 1 to stop writing a voltage to the control electrode of the driving transistor DT, and the second gate driving unit DRVG2 continues to write the second scanning signal at an invalid level to the second gate line G2 so as to control the sensing circuit 2 to stop writing a voltage to the second electrode of the driving transistor DT.

For the detailed description of steps S205 to S207, reference may be made to the detailed description of steps S105 to S107 according to the foregoing embodiments. Thus, the detailed description of steps S205 to S207 is omitted here.

Embodiments of the present disclosure further provide a computer-readable storage medium (e.g., a non-transitory computer-readable storage medium such as an optical disc, a magnetic disc, a flash memory, etc.) having a program (e.g., a computer program) stored thereon, and when executed by a processor, the program controls the first gate driving unit DRVG1, the second gate driving unit DRVG2, and the source driving unit DRVS of the driver DRV to perform the driving control method including the above-described steps S201 to S204 (as shown in FIG. 8) or the driving control method including the above-described steps S201 to S207 (as shown in FIG. 9).

In some embodiments, the driver DRV may be a timing controller, and the program may be stored in the timing controller (e.g., in a computer-readable storage medium of the timing controller). The timing controller may control operation states of the first gate driving unit DRVG1, the second gate driving unit DRVG2, and the source driving unit DRYS, thereby implementing the compensation and the display process of the steps S101 to S104 as described above, or implementing the compensation and the display process of the steps S101 to S107 as described above.

It should be noted that, relational terms such as first and second, and the like used herein are solely for distinguishing one entity or action from another entity or action without necessarily requiring or implying any sequence or significance relationship between such entities or actions. Further, the terms "comprise", "include", or any other variation thereof, are intended to cover a non-exclusive inclusion, such that a process, method, article, or apparatus that contains a list of elements may contain not only these elements but also other elements not expressly listed or inherent to such process, method, article, or apparatus. An element defined by the phrase "comprising a/an . . . ", without further limitation, does not exclude the presence of other identical elements in the process, method, article, or apparatus that comprises the element.

Exemplary embodiments in accordance with the present disclosure have been described above, which are not intended to be exhaustive or to limit the present disclosure to the precise embodiments disclosed. It is apparent that many modifications and variations are possible in light of the above description. The foregoing embodiments were chosen and described in order to best explain the principles of the present disclosure and the practical applications thereof, to thereby enable one of ordinary skill in the art to best utilize the present disclosure and various modifications based on the present disclosure. The scope of the present disclosure is limited only by the appended claims and their equivalents.

What is claimed is:

1. A driving method for a pixel circuit, wherein the pixel circuit comprises a driving transistor, a data writing circuit, a sensing circuit, and a storage capacitor;

the data writing circuit is coupled to a first gate line, a data line and a control electrode of the driving transistor, respectively, the sensing circuit is coupled to a second gate line, a signal sensing line and a second electrode of the driving transistor, respectively, a first electrode of the driving transistor is coupled to a first voltage terminal, a first terminal of the storage capacitor is coupled to the control electrode of the driving transistor, and a second terminal of the storage capacitor is coupled to the second electrode of the driving transistor;

the driving method comprises:

during a sensing write stage, writing a test voltage equal to a sum of a first reference voltage and a threshold voltage of the driving transistor, by the data writing circuit, to the control electrode of the driving transistor in response to control of the first gate line, and writing a second reference voltage, by the sensing circuit, to the second electrode of the driving transistor in response to control of the second gate line;

during a sensing sampling stage, continuing to write the test voltage to the control electrode of the driving transistor by the data writing circuit in response to the control of the first gate line, and stopping writing a voltage to the second electrode of the driving transistor by the sensing circuit in response to the control of the second gate line;

during a sensing reset stage, stopping writing a voltage to the control electrode of the driving transistor by the data writing circuit in response to the control of the first gate line, and writing the second reference voltage to the second electrode of the driving transistor again by the sensing circuit in response to the control of the second gate line; and during a sensing charging stage, continuing to stop writing a voltage to the control electrode of the driving transistor by the data writing circuit in response to the control of the first gate line, and allowing, by the sensing circuit, a current output from the second electrode of the driving transistor to flow to the signal sensing line in response to the control of the second gate line so as to charge the signal sensing line.

2. The driving method according to claim 1, further comprising, prior to the sensing write stage:

determining the threshold voltage of the driving transistor.

3. The driving method according to claim 2, further comprising, after the sensing charging stage:

during a data writing stage, writing a compensated data voltage to the control electrode of the driving transistor by the data writing circuit in response to the control of the first gate line, and writing the second reference voltage to the second electrode of the driving transistor by the sensing circuit in response to the control of the second gate line;

during an internal compensation stage, continuing to write the compensated data voltage to the control electrode of the driving transistor by the data writing circuit in response to the control of the first gate line, and stopping writing a voltage to the second electrode of the driving transistor by the sensing circuit in response to the control of the second gate line; and during a continuous light emission stage, stopping writing a voltage to the control electrode of the driving transistor by the data writing circuit in response to the control of the first gate line, and continuing to stop writing a voltage to the second electrode of the driving transistor by the sensing circuit in response to the control of the second gate line.

4. The driving method according to claim 3, wherein the data writing circuit comprises a first transistor; and the first transistor is turned on in response to a valid level signal provided from the first gate line to allow a path to be formed between the data line and the control electrode of the driving transistor.

5. The driving method according to claim 3, wherein the sensing circuit comprises a second transistor; and the second transistor is turned on in response to a valid level signal provided from the second gate line to allow a path to be formed between the signal sensing line and the second electrode of the driving transistor.

6. The driving method according to claim 2, wherein the data writing circuit comprises a first transistor; and the first transistor is turned on in response to a valid level signal provided from the first gate line to allow a path to be formed between the data line and the control electrode of the driving transistor.

7. The driving method according to claim 6, wherein the sensing circuit comprises a second transistor; and the second transistor is turned on in response to a valid level signal provided from the second gate line to allow a path to be formed between the signal sensing line and the second electrode of the driving transistor.

8. The driving method according to claim 2, wherein the sensing circuit comprises a second transistor; and the second transistor is turned on in response to a valid level signal provided from the second gate line to allow a path to be formed between the signal sensing line and the second electrode of the driving transistor.

9. The driving method according to claim 1, further comprising, after the sensing charging stage:

during a data writing stage, writing a compensated data voltage to the control electrode of the driving transistor by the data writing circuit in response to the control of the first gate line, and writing the second reference voltage to the second electrode of the driving transistor by the sensing circuit in response to the control of the second gate line;

during an internal compensation stage, continuing to write the compensated data voltage to the control electrode of the driving transistor by the data writing circuit in response to the control of the first gate line, and stopping writing a voltage to the second electrode of the driving transistor by the sensing circuit in response to the control of the second gate line; and during a continuous light emission stage, stopping writing a voltage to the control electrode of the driving transistor by the data writing circuit in response to the control of the first gate line, and continuing to stop writing a voltage to the second electrode of the driving transistor by the sensing circuit in response to the control of the second gate line.

10. The driving method according to claim 9, wherein the data writing circuit comprises a first transistor; and the first transistor is turned on in response to a valid level signal provided from the first gate line to allow a path to be formed between the data line and the control electrode of the driving transistor.

11. The driving method according to claim 10, wherein the sensing circuit comprises a second transistor; and the second transistor is turned on in response to a valid level signal provided from the second gate line to allow a path to be formed between the signal sensing line and the second electrode of the driving transistor.

12. The driving method according to claim 9, wherein the sensing circuit comprises a second transistor; and the second transistor is turned on in response to a valid level signal provided from the second gate line to allow a path to be formed between the signal sensing line and the second electrode of the driving transistor.

13. The driving method according to claim 1, wherein the data writing circuit comprises a first transistor; and the first transistor is turned on in response to a valid level signal provided from the first gate line to allow a path to be formed between the data line and the control electrode of the driving transistor.

14. The driving method according to claim 13, wherein the sensing circuit comprises a second transistor; and the second transistor is turned on in response to a valid level signal provided from the second gate line to allow a path to be formed between the signal sensing line and the second electrode of the driving transistor.

15. The driving method according to claim 1, wherein the sensing circuit comprises a second transistor; and the second transistor is turned on in response to a valid level signal provided from the second gate line to allow a path to be formed between the signal sensing line and the second electrode of the driving transistor.

16. The driving method according to claim 1, wherein the pixel circuit further comprises a supply circuit; and the supply circuit is coupled to a supply terminal of an analog-to-digital converter and a reference voltage terminal, and is configured to write the second reference voltage provided by the reference voltage terminal to the signal sensing line during the sensing write stage and the sensing reset stage, and write a detection current provided by the supply terminal of the analog-to-digital converter to the signal sensing line during the sensing charging stage.

17. The driving method according to claim 16, wherein the supply circuit comprises a first switch and a second switch; and a path is formed between the analog-to-digital converter and the signal sensing line when the first switch is in a turn-on state, and a path is formed between the reference voltage terminal and the signal sensing line when the second switch is in a turn-on state.

18. A driving control method for a pixel circuit, wherein the pixel circuit comprises a driving transistor, a data writing circuit, a sensing circuit, and a storage capacitor;

the data writing circuit is coupled to a first gate line, a data line and a control electrode of the driving transistor, respectively, the sensing circuit is coupled to a second gate line, a signal sensing line and a second electrode of the driving transistor, respectively, a first electrode of the driving transistor is coupled to a first voltage terminal, a first terminal of the storage capacitor is coupled to the control electrode of the driving transistor, and a second terminal of the storage capacitor is coupled to the second electrode of the driving transistor;

the driving control method comprises:

during a sensing write stage, providing a test voltage equal to a sum of a first reference voltage and a threshold voltage of the driving transistor, by a source driving unit, to the data line, writing a first scanning signal at a valid level, by a first gate driving unit, to the first gate line so as to control the data writing circuit to write the test voltage to the control electrode of the driving transistor, and writing a second scanning signal at a valid level, by a second gate driving unit, to the second gate line so as to control the sensing circuit to write a second reference voltage to the second electrode of the driving transistor;

during a sensing sampling stage, continuing to provide the test voltage, by the source driving unit, to the data line, writing the first scanning signal at the valid level, by the first gate driving unit, to the first gate line so as to control the data writing circuit to continue writing the test voltage to the control electrode of the driving transistor, and writing a second scanning signal at an invalid level, by the second gate driving unit, to the second gate line so as to control the sensing circuit to stop writing a voltage to the second electrode of the driving transistor;

during a sensing reset stage, writing a first scanning signal at an invalid level, by the first gate driving unit, to the first gate line so as to control the data writing circuit to stop writing a voltage to the control electrode of the driving transistor, and writing the second scanning signal at the valid level, by the second gate driving unit, to the second gate line again so as to control the sensing circuit to write the second reference voltage to the second electrode of the driving transistor; and during a sensing charging stage, continuing to write the first scanning signal at the invalid level, by the first gate driving unit, to the first gate line so as to control the data writing circuit to stop writing a voltage to the control electrode of the driving transistor, and continuing to write the second scanning signal at the valid level, by the second gate driving unit, to the second gate line so as to control the sensing circuit to allow a current output from the second electrode of the driving transistor to flow to the signal sensing line, so as to charge the signal sensing line.

19. The driving control method according to claim 18, further comprising, after the sensing charging stage:

during a data writing stage, providing the test voltage, by the source driving unit, to the data line, writing the first scanning signal at the valid level, by the first gate driving unit, to the first gate line so as to control the data writing circuit to write a compensated data voltage to the control electrode of the driving transistor, and writing the second scanning signal at the valid level, by the second gate driving unit, to the second gate line so as to control the sensing circuit to write the second reference voltage to the second electrode of the driving transistor;

during an internal compensation stage, continuing to provide the test voltage, by the source driving unit, to the data line, writing the first scanning signal at the valid level, by the first gate driving unit, to the first gate line so as to control the data writing circuit to continue writing the compensated data voltage to the control electrode of the driving transistor, and writing the second scanning signal at the invalid level, by the second gate driving unit, to the second gate line so as to control the sensing circuit to stop writing a voltage to the second electrode of the driving transistor; and during a continuous light emission stage, writing the first scanning signal at the invalid level, by the first gate driving unit, to the first gate line so as to control the data writing circuit to stop writing a voltage to the control electrode of the driving transistor, and continuing to write the second scanning signal at the invalid level, by the second gate driving unit, to the second gate line so as to control the sensing circuit to stop writing a voltage to the second electrode of the driving transistor.

20. A non-transitory computer-readable storage medium comprising a program stored therein, wherein when executed by a processor, the program controls the first gate driving unit, the second gate driving unit, and the source driving unit to implement the driving control method according to claim 18.

* * * * *